United States Patent [19]

Morigaki et al.

[11] Patent Number: 4,808,515

[45] Date of Patent: Feb. 28, 1989

[54] SILVER HALIDE COLOR PHOTOGRAPHIC MATERIAL

[75] Inventors: Masakazu Morigaki; Nobuo Seto, both of Kanagawa, Japan

[73] Assignee: Fuji Photo Film Co., Ltd., Kanagawa, Japan

[21] Appl. No.: 911,172

[22] Filed: Sep. 24, 1986

[30] Foreign Application Priority Data

Sep. 24, 1985 [JP] Japan ..... 60-208585

[51] Int. Cl.[4] ..... G03C 7/38; G03C 7/32

[52] U.S. Cl. ..... 430/551; 430/548; 430/558

[58] Field of Search ..... 430/558, 551, 372, 386, 430/387, 548, 610

[56] References Cited

U.S. PATENT DOCUMENTS

| | | | |
|---|---|---|---|
| 4,540,653 | 9/1985 | Nishijima et al. | 430/372 |
| 4,576,910 | 3/1986 | Hirano et al. | 430/548 |
| 4,675,275 | 6/1987 | Nishijima et al. | 430/372 |
| 4,684,603 | 8/1987 | Nishijima et al. | 430/558 |

FOREIGN PATENT DOCUMENTS

| | | | |
|---|---|---|---|
| 0185506 | 6/1986 | European Pat. Off. | 430/551 |
| 0187521 | 7/1986 | European Pat. Off. | 430/551 |

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

A silver halide color photographic material comprising a support having thereon at least one silver halide emulsion layer, the silver halide color photographic material containing at least one pyrazoloazole type coupler represented by the general formula (I) and at least one compound represented by the general formula (II).

(I)

wherein $R_1$ represents a hydrogen atom or a substituent; X represents a hydrogen atom or a group capable of being released upon coupling reacti1 Za, Zb and Zc each represents a methine group, a substituted methine grou =N— or —NH—, one of the Za—Zb bond and the Zb—Zc bond being a double bond and the other being a single bond; when the Zb—Zc bond is a carbon-carbon double bond, the Zb—Zc bond may be a part of a condensed aromatic ring; $R_1$ or X may also form a polymer including a dimer or more; and when Za, Zb or Zc is a substituted methine group, the substituted methine group may form a polymer including a dimer or more, with the proviso that when Za and Zb are nitrogen atoms and Zc is a methine group or a substituted methine group, X is not a hydrogen atom, (II)

wherein M represents nickel, cobalt, maganese, copper, iron, zinc, palladium or platinum; an $R_5$ and $R_6$, each represesnts an alkyl group, aryl group, alkoxy group, alkylthio group, aryloxy group or an arylthio group.

The silver halide color photographic material provides magenta color image having improved fastness to light, humidity and heat without accompanying with coloration of white background.

21 Claims, No Drawings

SILVER HALIDE COLOR PHOTOGRAPHIC MATERIAL

FIELD OF THE INVENTION

The present invention relates to a silver halide color photographic material containing a combination of a pyrazoloazole type magenta coupler and a specific color image stabilizer particularly effective to improve light fastness of a dye image formed from the coupler.

BACKGROUND OF THE INVENTION

It is well known that when a silver halide color photographic material is subjected to color development, an oxidized aromatic primary amine color developing agent reacts with a coupler to form a dye such as an indophenol, an indoaniline, an indamine, an azomethine, a phenoxazine, a phenazine and the like, thus forming a color image. In order to form a magenta color image, a 5-pyrazolone coupler, a cyanoacetophenone coupler, an indazolone coupler, a pyrazolobenzimidazole coupler or a pyrazolotriazole coupler is generally employed.

Magenta color image forming couplers which have been widely used in practice and on which various investigations have been made are almost all 5-pyrazolones. It is known that dyes formed from 5-pyrazolone couplers are excellent in fastness to heat and light but they have an undesirable absorption of yellow component in the region around 430 nm, which causes color turbidity.

In order to reduce yellow component absorption, a pyrazolobenzimidazole nucleus as described in British Pat. No. 1,047,612, an indazolone nuclues as described in U.S. Pat. No. 3,770,447 and a 1H-pyrazolo[5,1-c][1,2,4]triazole nucleus as described in U.S. Pat. No. 3,725,067 have been proposed as a magenta color image forming coupler skeleton. Further, a 1H-imidazo[1,2-b]pyrazole nucleus as described in Japanese patent application (OPI) No. 162548/84, a 1H-pyrazolo[1,5-b][1,2,4]triazole nucleus as described in Japanese patent application (OPI) No. 171956/84, a 1H-pyrazolo[1,5-d]tetrazole nucleus as described in Japanese patent application (OPI) No. 33552/85 and a 1H-pyrazolo[1,5-b]pyrazole nucleus as described in Japanese patent application (OPI) No. 43659/85 have been recently proposed as novel magenta color image forming coupler skeletons.

Among these magenta couplers, the magenta dyes formed from the 1H-pyrazolo[5,1-c][1,2,4]triazole couplers described in U.S. Pat. No. 3,725,067 and British Pat. Nos. 1,252,418 and 1,334,515; the 1H-imidazo[1,2-b]pyrazole couplers described in Japanese patent application (OPI) No. 162548/84, the 1H-pyrazolo-[1,5-b][1,2,4]triazole couplers described in Japanese patent application (OPI) No. 171956/84; the 1H-pyrazolo[1,5-d]tetrazole couplers described in Japanese patent application (OPI) No. 33552/85; and the 1H-pyrazolo[1,5-b]pyrazole couplers described in Japanese patent application (OPI) No. 43659/85 show excellent absorption characteristics free from the undesirable absorption of yellow component as described above in a solvent such as ethyl acetate, dibutyl phthalate, etc., and thus they provide preferable color separation.

Of these magenta couplers, however, the 1H-pyrazolo[5,1-c][1,2,4]triazole type couplers provide azomethine dyes which have remarkably low fastness to light and greatly reduce the desired properties of color photographic light-sensitive materials, in particular, color photographic light-sensitive materials for prints. Further, other novel nitrogen containing heterocyclic 5-membered ring-condensed-5-membered ring couplers as described above provide azomethine dyes having light fastness which is insufficient for use in color photographic light-sensitive materials, particularly in color photographic light-sensitive materials for prints.

In order to improve light fastness of dyes formed from these nitrogen containing heterocyclic 5-membered ring-condensed-5-membered ring couplers, there have been proposed a method wherein an organic color image stabilizing compound is incorporated into a photographic layer as described in Japanese patent application (OPI) No. 125732/84 and a method wherein a metal complex mainly composed of salicilaldoxy type is incorporated into a photographic layer as described in Japanese patent application (OPI) No. 97353/85. Photographic materials containing these compounds, in fact, exhibit improved light fastness. However, the improvement in light fastness is still insufficient and, thus, it has been desired to develop a color image stabilizer which has greater effects.

Further, most of metal complexes are colored themselves and therefore, when they are incorporated in a large amount, a problem occurs in that white background is colored.

SUMMARY OF THE INVENTION

An object of the present invention is to provide a silver halide color photographic material containing a pyrazoloazole coupler represented by the general formula (I) hereinafter described, which provides a magenta color image having improved fastness to light, humidity or heat.

Another object of the present invention is to provide a silver halide color photographic material which provides a magenta color image having improved fastness without coloration of white background.

Other objects of the present invention will become apparent from the following detailed description and examples.

The objects of the present invention can be accomplished by a silver halide color photographic material comprising a support having thereon at least one silver halide emulsion layer, the silver halide color photographic material containing at least one pyrazoloazole coupler represented by the general formula (I) described below and at least one compound represented by the general formula (II), (III) or (IV) described below.

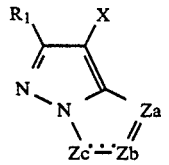

(I)

wherein $R_1$ represents a hydrogen atom or a substituent; X represents a hydrogen atom or a group capable of being released upon a coupling reaction with an oxidation product of an aromatic primary amine developing agent; Za, Zb and Zc each represents a methine group, a substituted methine group, =N— or —NH—, one of the Za—Zb bond and the Zb—Zc bond being a double bond and the other being a single bond; when the Zb—Zc bond is a carbon-carbon double bond, the Zb—Zc bond may be a part of a condensed aromatic ring; $R_1$ or X may also form a polymer including a dimer or more; and when Za, Zb or Zc is a substituted methine group, the substituted methine group may be a linking group to form a polymer including a dimer or more; with the proviso that when Za and Zb are nitrogen atoms and Zc is a methine group or a substituted methine group, X is not a hydrogen atom, (II)

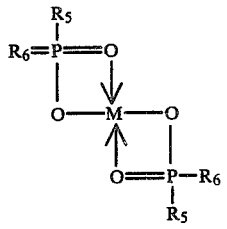

(III)

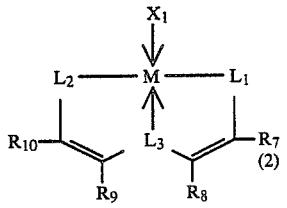

(2)

(IV)

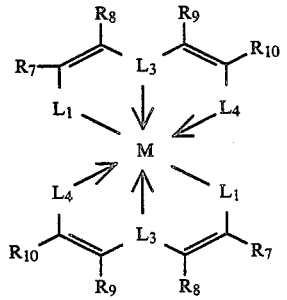

wherein M represents a nickel atom, a cobalt atom, a manganese atom, a copper atom, an iron atom, a zinc atom, a palladium or a platinum atom; $X_1$ represents a compound capable of coordinating to M; $L_1$ and $L_2$, which may be the same or different, each represents an oxygen atom, a sulfur atom or —$NR_{11}$— (wherein $R_{11}$ represents a hydrogen atom, an alkyl group, an aryl group, a hydroxy group or an alkoxy group); $L_3$ represents an oxygen atom, a sulfur atom or —NH—; $L_4$ represents a hydroxy group, an alkoxy group, an alkylthio group or —$NR_{12}R_{13}$ (wherein $R_{12}$ and $R_{13}$, which may be the same or different, each represents a hydrogen atom or an alkyl group); $R_5$ and $R_6$, which may be the same or different, each reprresents an alkyl group, an aryl group, an alkoxy group, an alkylthio group, an aryloxy group or an arylthio group; and $R_7$, $R_8$, $R_9$ and $R_{10}$, which may be the same or different, each represents a hydrogen atom, an alkyl group or an aryl group, or at least one of the pairs of $R_7$ and $R_8$ and $R_9$ and $R_{10}$ may be connected to each other to form a 5-membered or 6-membered ring.

DETAILED DESCRIPTION OF THE INVENTION

The pyrazoloazole coupler represented by the general formula (I) above which can be employed in the present invention is described in detail below.

The term "polymer" as used in the definition for the general formula (I) means a compound containing at least two groups represented by the general formula (I) in its molecule, and includes a bis coupler and a polymer coupler. Preferably, degree of polymerization is 2 to 10,000. The term "polymer coupler" as herein used include a homopolymer composed of only a monomer having a moiety represented by the general formula (I), and preferably having a vinyl group (the monomer having a vinyl group will hereinafter be referred to as a vinyl monomer), and a copolymer composed of a vinyl monomer described aabove and a non-color forming ethylenic monomer which does not undergo coupling with the oxidation product of an aromatic primary amine developing agent. Preferably, the molar ratio of the non-color forming ethylenic monomer to the vinyl monomer is 0.1:1 to 10:1. The compounds represented by the general formula (I) are nitrogen containing heterocyclic 5-membered ring-condensed-5-membered ring couplers. Their color forming nuclei show aromaticity isoelectronic to naphthalene and have chemical structures inclusively called azapentalene. The preferred compounds among the couplers represented by the general formula (I) are 1H-imidazo]1,2-b]pyrazoles, 1H-pyrazolo[5,1-c][1,2,4]triazoles, 1H-pyrazolo[1,5-b]pyrazoles, 1H-pyrazolo[1,5-b][1,2,4]triazoles, 1H-pyrazolo[1,5-d]tetrazoles and 1H-pyrazolo[1,5-a]benzimidazoles represented by the general formulae (I-1), (I-2), (I-3), (I-4), (I-5) and (I-6), respectively. Of them, the compounds represented by the general formulae (I-1) and (I-4) are particularly preferred.

(I-1)

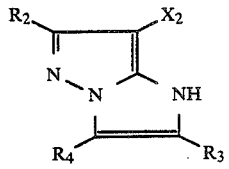

(I-2)

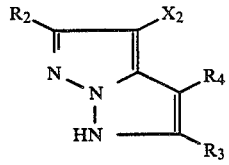

(I-3)

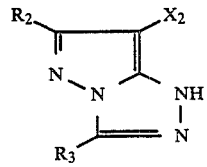

(I-4)

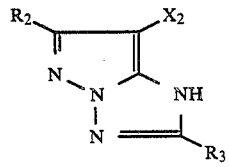

(I-5)

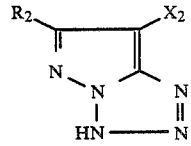

-continued

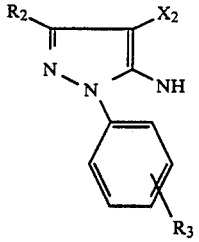

(I-6)

In the general formula (I-1), (I-2), (I-3), (I-4), (I-5) or (I-6), $R_2$, $R_3$ and $R_4$, which may be the same or different, each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group (preferably, aliphatic groups such as the alkyl, alkoxy, acyloxy, acylamino, alkylthio, acyl, alkoxycarbonyl and alkoxycarbonylamino groups have 1 to 25 carbon atoms, aromatic groups such as the aryl, aryloxy, arylthio, aryloxycarbonyl and aryloxycarbonylamino groups have 6 to 25 carbon atoms, the heterocyclic group is a 3- to 7-membered heterocyclic group containing one or more of N, S, O, Se or Te, preferably N, S or O, as hetero atom(s); the heterocyclic oxy and heterocyclic thio groups contain a 3- to 7-membered heterocyclic moiety containing one or more of N, S, O, Se or Te, preferably N, S or O, as hetero atom(s); the carbamoyloxy, silyloxy, sulfonyloxy, anilino, ureido, imido, sulfamoylamino, carbamoylamino, sulfonamido, carbamoyl, sulfamoyl, sulfonyl, and sulfinyl groups may have a substituent selected from the above-described aliphatic groups and/or aromatic groups); and $X_2$ represents a hydrogen atom, a halogen atom, a carboxy group or a group capable of being released upon coupling which is bonded to the carbon atom at the coupling position through an oxygen atom, a nitrogen atom or a sulfur atom. It is preferred that $X_2$ represents one of the above described substituents other than a hydrogen atom. Also, $R_2$, $R_3$, $R_4$ or $X_2$ may be a divalent group to form a bis coupler. Further, the coupler represented by the general formula (I-1), (I-2), (I-3), (I-4), (I-5) or (I-6) may be in the form of a polymer coupler in which the general formula constitutes a partial structure of a vinyl monomer and $R_2$, $R_3$ or $R_4$ represents a chemical bond or a linking group, through which the partial structure of the formula (I-1), (I-2), (I-3), (I-4), (I-5) or (I-6) and the vinyl group are connected together.

In more detail, $R_2$, $R_3$ and $R_4$ each represents a hydrogen atom, a haogen atom (e.g., a chlorine atom, a bromine atom, etc.), an alkyl group (e.g., a methyl group, a propyl group, a tert-butyl group, a trifluoromethyl group, a tridecyl group, a 3-(2,4-di-tert-amylphenoy)-propyl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-tert-butylphenyl group, a 2,4-di-tert-amylphenyl group, a 4-tetradecanamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-tert-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino group (e.g., an acetamido group, a benzamido group, a tetradecanamido group, an α-(2,4-ditert-amylphenoxy)-butylamido group, a γ-(3-tert-butyl-4-hydroxyphenoxy)butylamino group, an α-[4-(4-hydroxyphenylsulfonyl)phenoxy]decanamido group, etc.), an anilino group (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-tert-butyl-4-hydroxyphenoxy)dodecanamido]anilino group, etc.), aa ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-tert-butylphenoxy)propylthio group, etc.), an arylthio group (e.g., a phenylthio group, a 2-butoxy-5-tert-octylphenylthio group, a 3-pentadecylphenylthio group, a 2-carboxyphenylthio group, a 4-tetradecanamidophenylthio group, etc.), a heterocyclic thio group (e.g., a 2-benzothiazolythio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-tert-butylphenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-tert-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tert-amylphenoxy)propyl]-carbamoyl group, etc.), an acyl group (e.g., an acetyl group, a (2,4-di-tert-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.) a sulfonyl group (e.g., a methanesulfonyl group, an octanesulfonyl group, a benzenesulfonyl group, a toluenesulfonyl group, etc.), sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecyloxycarbonyl group, an octadecyloxycarbonyl group, etc.) or an aryloxycarbonyl group (e.g., a phenyloxycarbonyl group, a 3-pentadecylphenyloxycarbonyl group, etc.); and X represents a hydrogen atom; a halogen atom (e.g., a chlorine atom, a bromine atom, an iodine atom, etc.); a carboxy group; a group bonded to the coupling position through an oxygen atom (e.g., an acetoxy group, a propanoyloxy group, a benzoyloxy group, a 2,4-dichlorobenzoyloxy group, an ethoxyoxaloyloxy group, a pyruvyloyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.); a group bonded to the coupling position through a nitrogen atom (e.g., a benzenesulfonamido group, an N-ethyltoluenesulfonamido group, a heptafluorobutanamido group, a 2,4,5,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzyl-5-ethoxy-3-hydantoinyl group, a 2N-1,1-dioxo-3-(2H)-oxo-1,2-benzisothiazolyl group, a 2-oxo-1,2-dihydro-1-pyridinyl group, an imidazolyl group, a pyrazoloyl group, a 3,5-diethyl-1,2,4-triazol-1-yl group, a 5- or 6-bromobenzotriazole-1-yl group, a 5-methyl-1,2,3,4-triazole-1-yl group, a benzimidazolyl group, a 3-benzyl-1-hydantoinyl group, a 1-benzyl-5-hexadecyloxy-3-hydantoinyl group, a 5-methyl-1-tetrazolyl group, a 4-methoxyphenylazo group, a 4-pivaloylaminophenylazo group, a 2-hydroxy-4-propanoylphenylazo group, etc.; or a group bonded to the coupling position through a sulfur atom (e.g., a phenylthio group, a 2-carboxyphenylthio group, a 2-methoxy-5-tert-octylphenylthio group, a 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolythio group, a 2-dodecyl thio-5-thiophenylthio group, a 2-phenyl-3-dodecyl-1,2,4-triazolyl-5-thio group, etc. (the groups bonded to the coupling position through an oxygen sulfur or nitrogen atom is described in, e.g., U.S. Pat. No. 4,540,654)).

When $R_2$, $R_3$, $R_4$ or X represents a divalent group to form a bis coupler, such a divalent group includes a substituted or unsubstituted alkylene group having 1 to 20 carbon atoms (e.g., a methylene group, an ethylene group, a 1,10-decylene group, $—CH_3CH_2—O—CH_2CH_2—$, etc.), a substituted or unsubstituted phenylene group (e.g., a 1,4-phenylene group, a

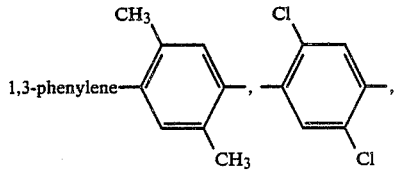

etc.), an —NHCO—R—CONH— group (wherein R represents a substituted or unsubstituted alkylene having 1 to 20 carbon atoms or phenylene group).

The linking group represented by $R_2$, $R_3$, $R_4$ or X in the cases wherein the coupler moiety represented by the general formula (I-1), (I-2), (I-3), (I-4), (I-5) or (I-6) is included in a vinyl monomer includes an alkylene group having 1 to 20 carbon atoms (including a substituted or unsubstituted alkylene group, e.g., a methylene group, an ethylene group, a 1,10-decylene group, $—CH_2CH_3OCH_2CH_2$, etc.), a phenylene group (including a substituted or unsubstituted phenylene group, e.g., a 1,4-phenylene group, a 1,3-phenylene group,

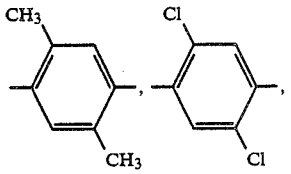

etc.), —NHCO—, —CONH—, —O—, —OCO—, and an aralkylene group having 7 to 20 carbon atoms (including a substituted or unsubstituted aralkylene group, e.g.,

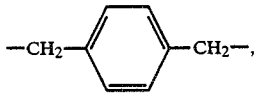

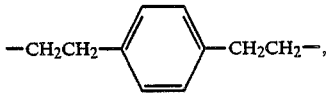

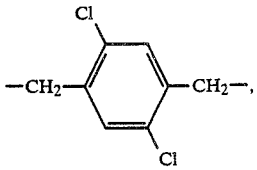

etc.) or a combination thereof (having 2 to 30 total carbon atoms).

Further, a vinyl group in the vinyl monomer may further have a substituent in addition to the coupler moiety represented by general formula (I-1), (II-2), (I-3), (I-4), (I-5) or (I-6). Preferred examples of the substituents include a hydrogen atom, a chlorine atom or a lower alkyl group having from 1 to 4 carbon atoms.

Examples of non-color forming ethylenic monomers which do not undergo coupling with the oxidation product of an aromatic primary amine developing agent include acrylic acid and derivatives thereof such as acrylic acid, α-chloroacrylic acid, α-alkyl substituted acrylic acid (e.g., methacrylic acid, etc.), etc., an ester or an amide derived from these acrylic acids (e.g., acrylamide, n-butylacrylamide, tert-butylacrylamide, diacetoneacrylamide, methacrylamide, methylenebisacrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate, β-hydroxyethyl methacrylate, etc.), a vinyl ester (e.g., vinyl acetate, vinyl propionate, vinyl laurate, etc.), acrylonitrile, methacrylonitrile, an aromatic vinyl compound (e.g., styrene and derivatives thereof, vinyltoluene, divinylbenzene, vinylacetophenone, sulfostyrene, etc.), itaconic acid, citraconic acid, crotonic acid, vinylidene chloride, a vinyl alkyl ether (e.g., vinyl ethyl ether, etc.), maleic acid, maleic anhydride, a maleic acid ester, N-vinyl-2-pyrrolidone, N-vinylpyridine, 2- or 4-vinylpyridine, etc.

Two or more non-color forming ethylenically unsaturated monomers can be used together.

Specific examples of the pyrazoloazole type magenta couplers represented by the general formulae (I-1), (I-2), (I-3), (I-4), (I-5) and (I-6) which can be used in the present invention and methods for synthesis thereof are described in the following literatures.

The compounds of the general formula (I-1) are described in Research Disclosure, RD No. 24531 (Sept. 10, 1984), etc., the compounds of the general formula (I-2) are described in Japanese patent application (OPI) No. 43659/85, etc., the compounds of the general formula (I-3) are described in U.S. Pat. No. 3,061,432, etc., the compounds of the general formula (I-4) are described in U.S. Pat. No. 4,540,654, etc., the compounds of the general formula (I-5) are described in Japanese patent application (OPI) No. 33552/85, etc., and the compounds of the general formula (I-6) are described in U.S. Pat. No. 3,061,432, etc., respectively.

In addition, highly color forming ballast groups as described, for example, in Japanese patent application (OPI) Nos. 42054/83, 214854/84, 177553/84, 177554/84 and 177557/84, etc. can be applied to any of the compounds represented by the general formula (I-1), (I-2), (I-3), (I-4), (I-5) or (I-6) described above.

Methods of synthesizing the couplers represented by formula (I) are well known in the art and are described, for example, in the documents cited in the foregoing paragraphs.

Specific examples of the pyrazoloazole type couplers which can be employed in the present invention are set forth below, but the present invention should not be construed as being limited thereto.

(M-1)

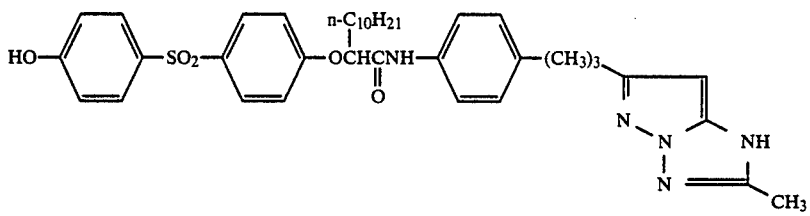

(M-2)

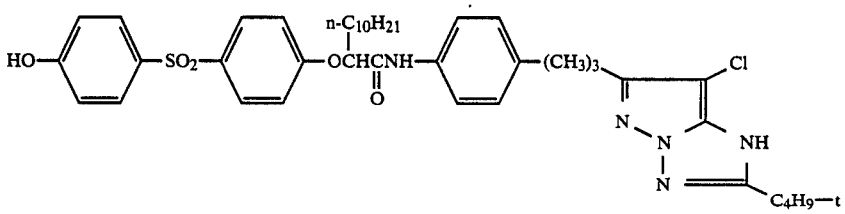

(M-3)

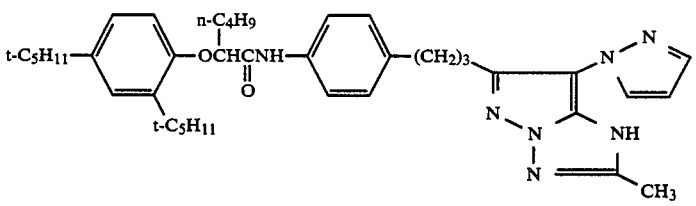

(M-4)

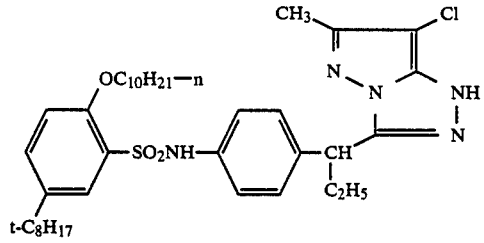

(M-5)

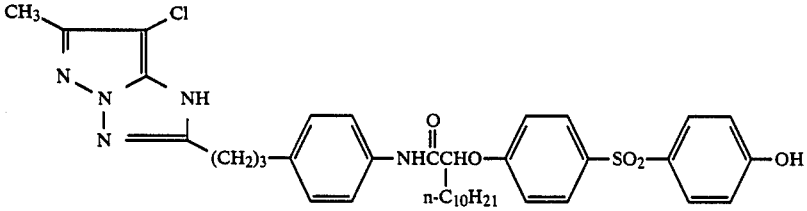

-continued
(M-6)
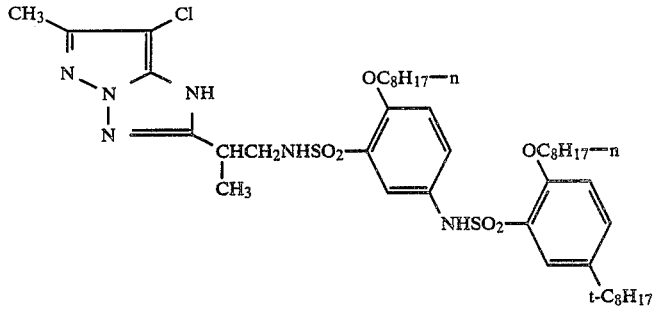
(M-7)
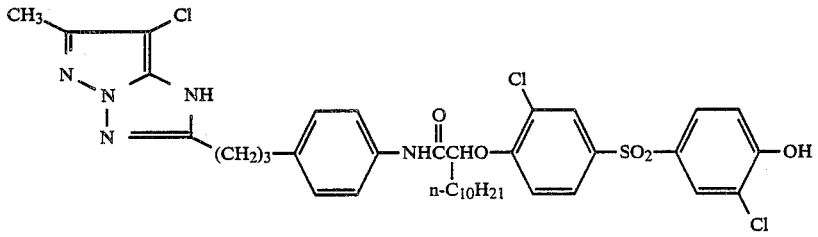
(M-8)
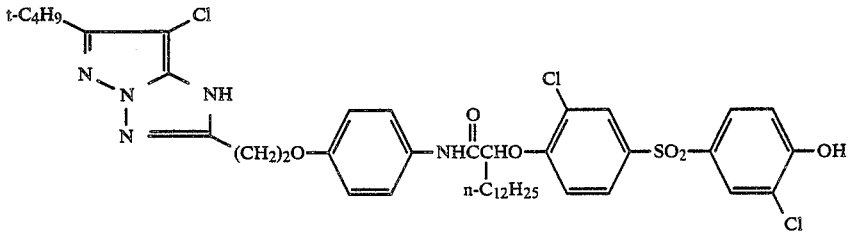
(M-9)
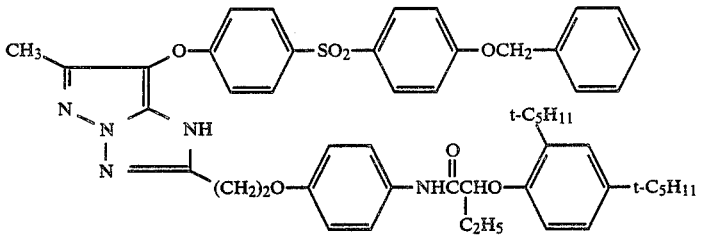
(M-10)
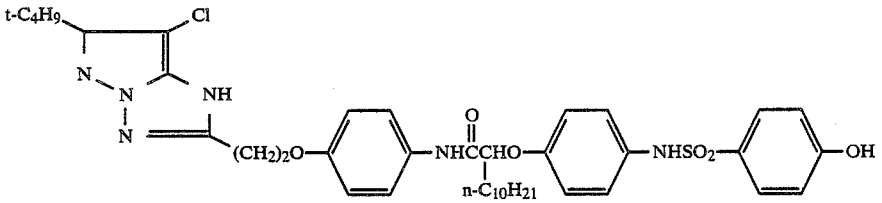
(M-11)
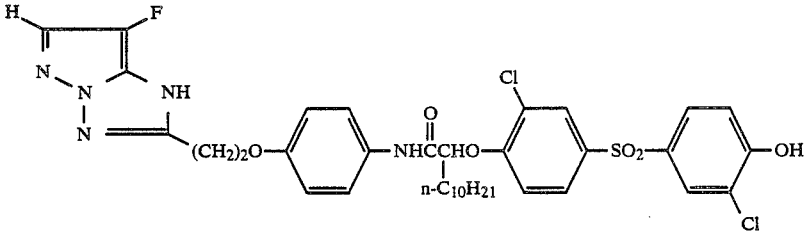

-continued
(M-12)
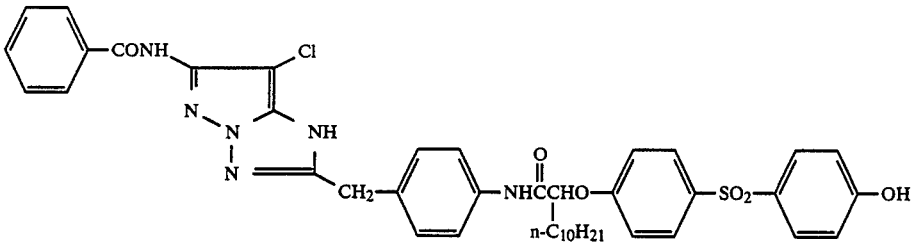
(M-13)
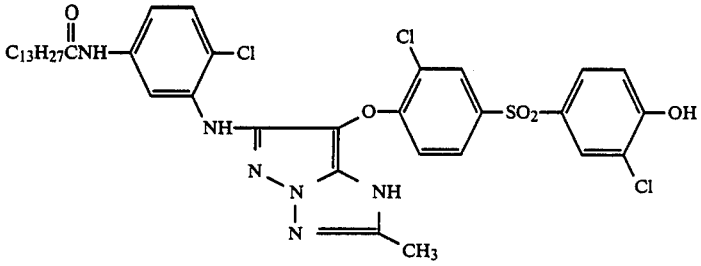
(M-14)
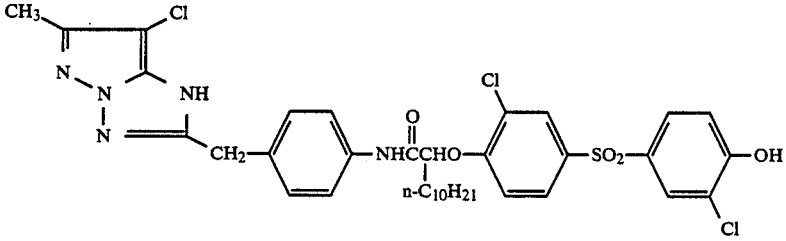
(M-15)
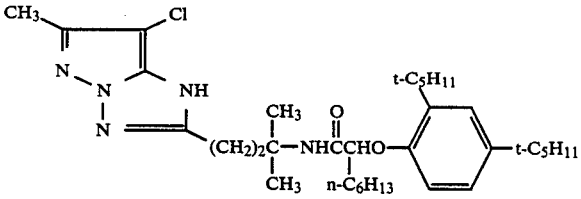
(M-16)
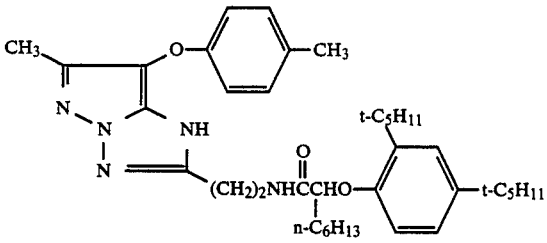
(M-17)
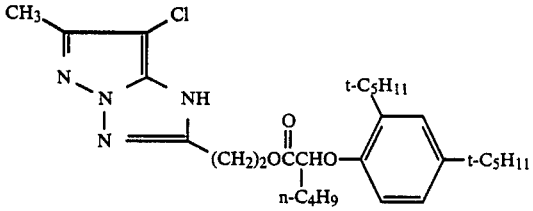

-continued
(M-18)
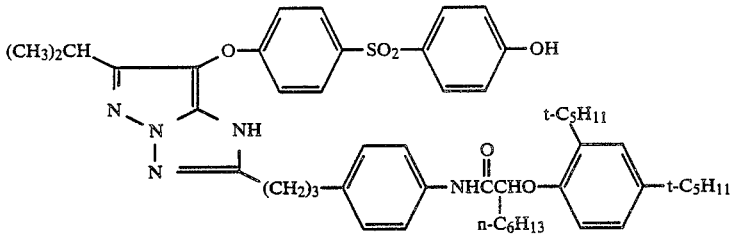
(M-19)
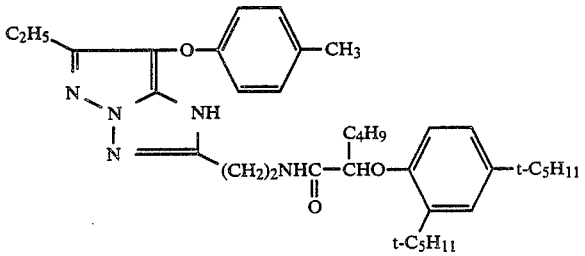
(M-20)
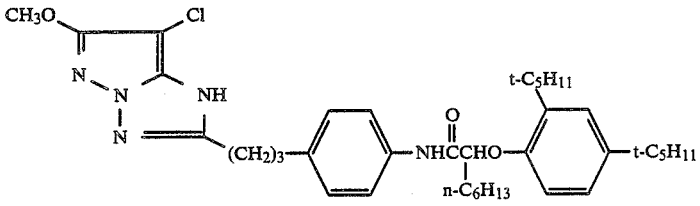
(M-21)
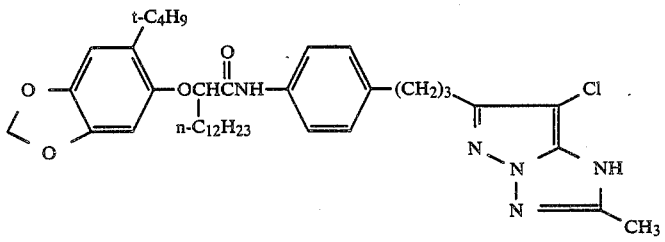
(M-22)
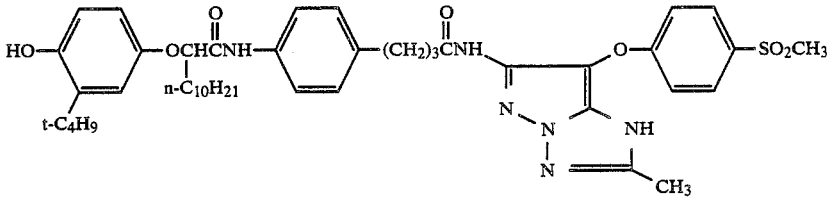
(M-23)
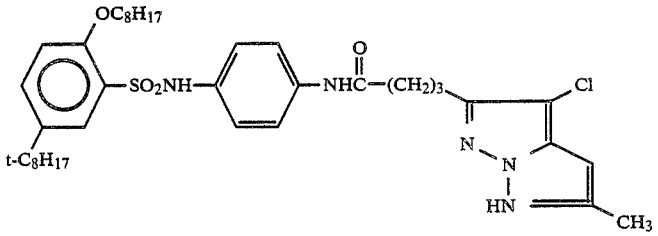

-continued
(M-24)
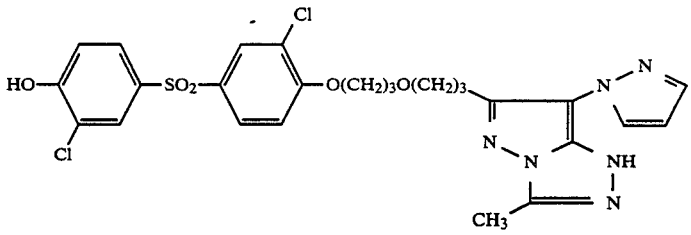
(M-25)
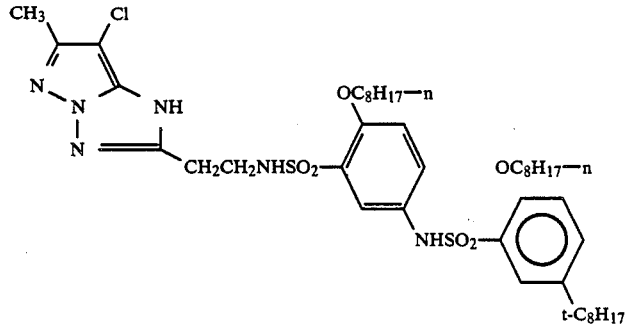
(M-26)
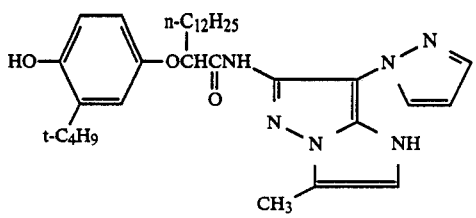
(M-27)
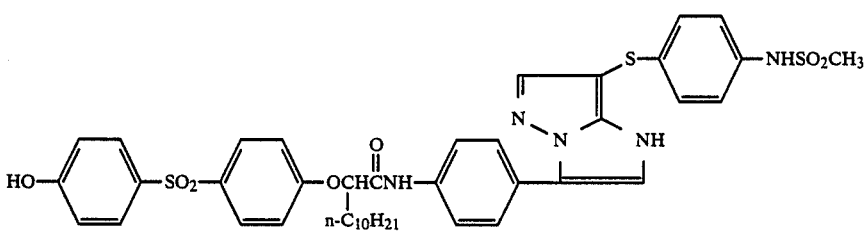
(M-28)
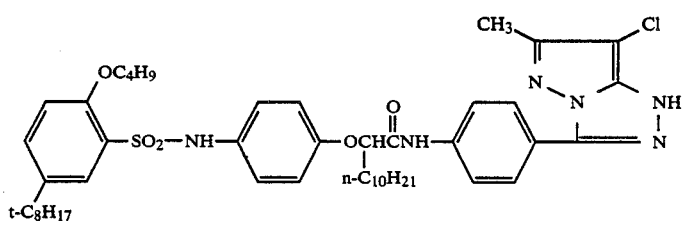
(M-29)
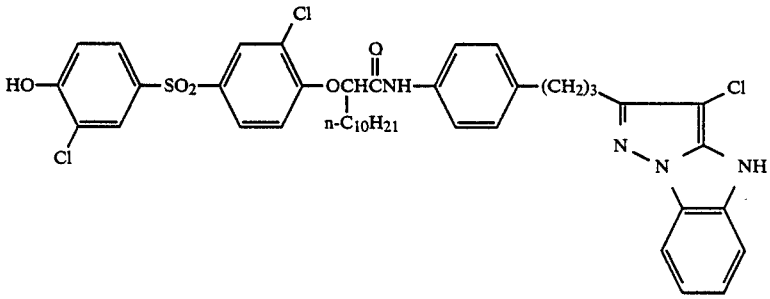

-continued
(M-30)
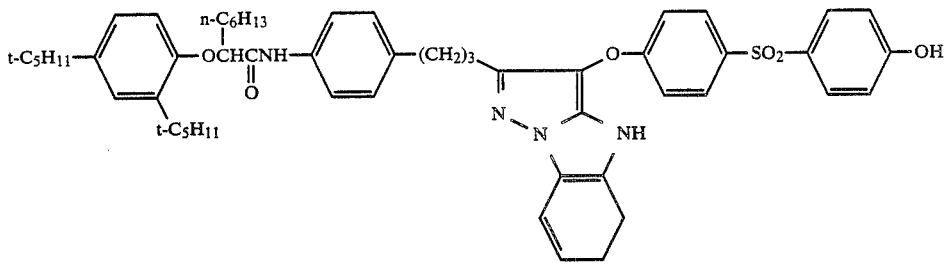
(M-31)
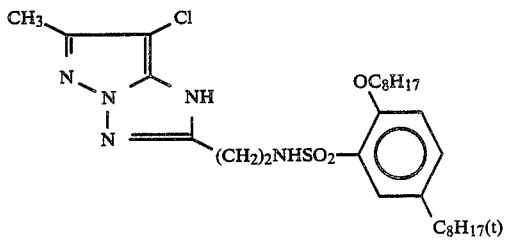
(M-32)
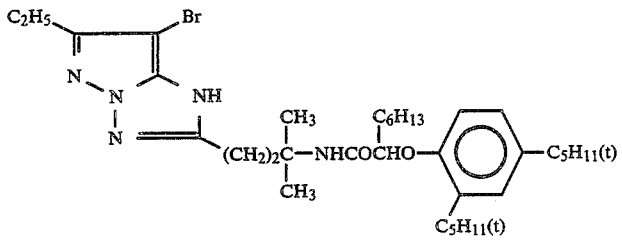
(M-33)
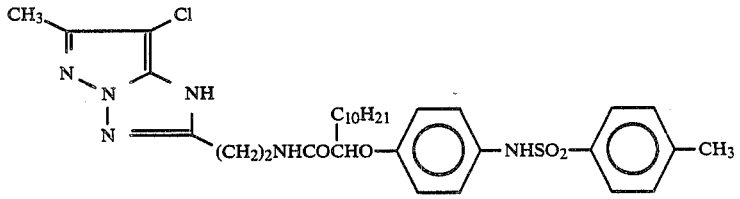
(M-34)
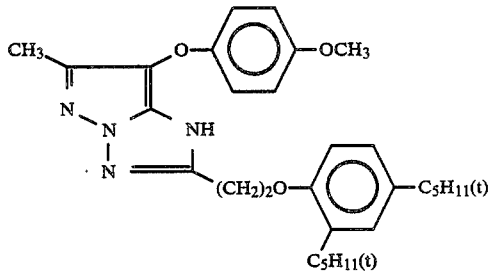
(M-35)
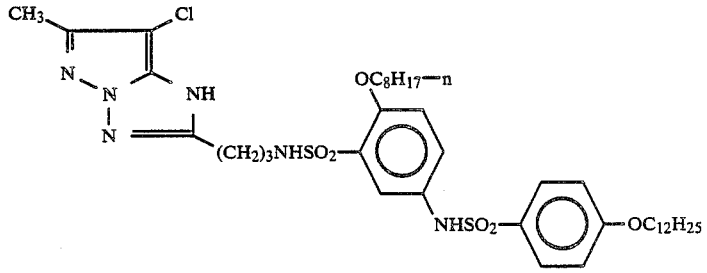

-continued
(M-36)
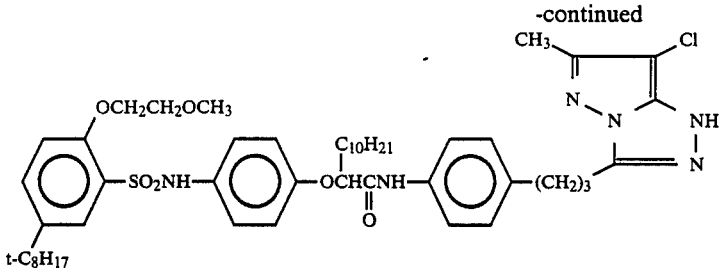
(M-37)
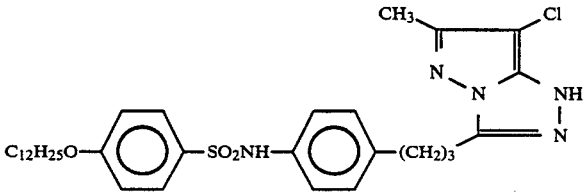
(M-38)
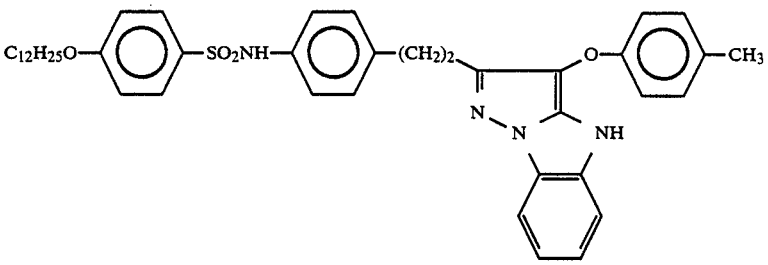
(M-39)
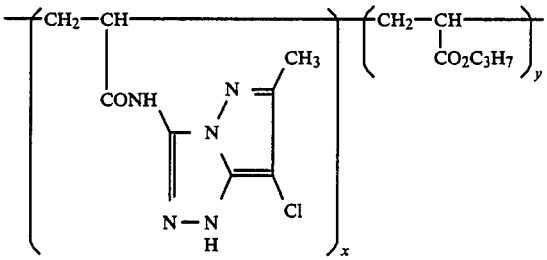
x:y = 55:45
(by weight)
(M-40)
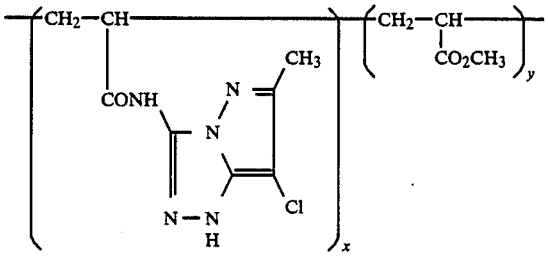
x:y = 40:60
(by weight)
(M-41)
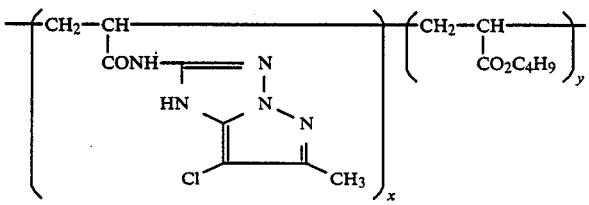
x:y = 50:50
(by weight)

-continued (M-42)

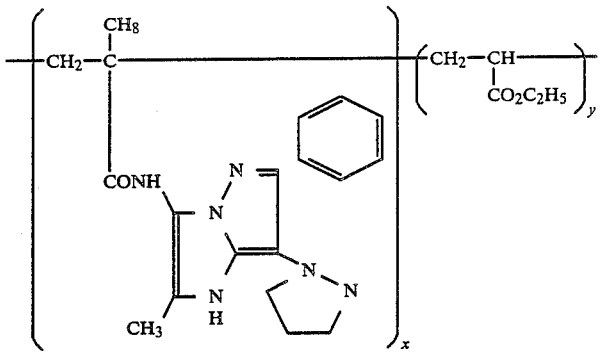

x:y = 55:45
(by weight)

(M-43)

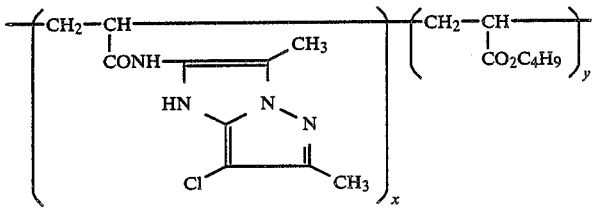

x:y = 50:50
(by weight)

The coupler according to the present invention is usually incorporated into a layer in an amount of from $2\times10^{-3}$ to $5\times10^{-1}$ mol, and preferably from $1\times10^{-2}$ to $5\times10^{-1}$ mol, per mol of silver.

In the following discussion, the color image stabilizers represented by the general formula (II), (III) or (IV) described above are described in more detail.

In the general formula (II), (III) or (IV), M represents a nickel atom, a cobalt atom, a manganese atom, a copper atom, an iron atom, a zinc atom, a palladium atom or a platinum atom. Of these atoms, a nickel atom is particularly preferred.

$X_1$ represents a compound capable of coordinating to M. The compound capable of coordinating is a compound which contains a hetero atom (for example, an oxygen atom, a nitrogen atom, a sulfur atom, a phosphorus atom, etc.) having a lone pair of electrons and includes, for example, water, ammonia, triethanolamine, cyclohexylamine, etc. Of the compounds, those represented by the formula $R_{14}$—O—$R_{15}$, $R_{14}$—S—$R_{15}$,

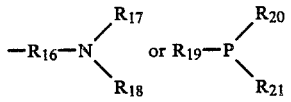

are preferred. In the above formulae, $R_{14}$, $R_{15}$, $R_{16}$, $R_{17}$, $R_{18}$, $R_{19}$, $R_{20}$, and $R_{21}$, which may be the same or different, each represents a hydrogen atom, an alkyl group having 1 to 25 carbon atoms or an aryl group having 6 to 25 carbon atoms; and $R_{16}$, $R_{17}$, $R_{18}$, $R_{19}$, $R_{20}$ or $R_{21}$ further represents a hydroxy group, an alkoxy group having 1 to 25 carbon atoms or an aryloxy group having 6 to 25 carbon atoms.

$L_1$ and $L_2$, which may be the same or different, each represents an oxygen atom, a sulfur atom or —$NR_{11}$— [wherein $R_{11}$ represents a hydrogen atom, an alkyl group having 1 to 25 carbon atoms (for example, a methyl group, an ethyl group, an isopropyl group, a cyclohexyl group, a tert-butyl group, a benzyl group, a methoxyethyl group, etc.), an aryl group having 6 to 25 carbon atoms (for example, a phenyl group, a p-methylphenyl group, a m-methoxyphenyl group, p-chlorophenyl group, an α-naphthyl group, etc.), a hydroxy group or an alkoxy group having 1 to 25 carbon atoms (for example, a methoxy group, an ethoxy group, a cyclohexyloxy group, a methoxyethoxy group, a benzyloxy group, etc.)]. It is preferred that both $L_1$ and $L_2$ are oxygen atoms.

$L_3$ represents an oxygen atom, a sulfur atom or —NH— with a sulfur atom being preferred.

$L_4$ represents a hydroxy group, an alkoxy group having 1 to 25 carbon atoms (for example, a methoxy group, an ethoxy group, a methoxyethoxy group, etc.), an alkylthio group having 1 to 25 carbon atoms (for example, a methylthio group, an ethylthio group, etc.) or —$NR_{12}R_{13}$ [wherein $R_{12}$ and $R_{13}$, which may be the same or different, each represents a hydrogen atom or an alkyl group having 1 to 25 carbon atoms (for example, a methyl group, an ethyl group, etc.)].

$R_5$ and $R_6$, which may be the same or different, each represents an alkyl group having 1 to 25 carbon atoms (for example, a methyl group, an ethyl group, a sec-butyl group, an isopropyl group, a tert-butyl group, a n-octyl group, a n-dodecyl group, a n-hexadecyl group, a benzyl group, a methoxyethyl group, a cyclohexyl group, a 3-hydroxy-n-hexyl group, etc.), an aryl group having 6 to 25 carbon atoms (for example, a phenyl group, a p-methoxyphenyl group, a p-hydroxyphenyl group, a m-chlorophenyl group, a β-naphthyl group, etc.), an alkoxy group having 1 to 25 carbon atoms (for example, a methoxy group, an isopropyloxy group, a cyclohexyloxy group, a n-butyloxy group, a n-hexyloxy group, a n-octyloxy group, a n-decyloxy group, a n-hexadecyloxy group, a benzyloxy group, a methoxyethoxy group, etc.), an alkylthio group having 1 to 25 carbon atoms (for example, a methylthio group, an ethylthio group, an isobutylthio group, a cyclohexylthio group, a benzylthio group, a n-octylthio group, a hexadecylthio group, etc.), an aryloxy group having 6 to 25 carbon atoms (for example, a phenyloxy group, a p-methoxyphenyloxy group, a β-naphthyloxy group, etc.) or an arylthio group having 6 to 25 carbon atoms (for example, a phenylthio group, a p-hydroxyphenylthio group, a m-methylphenylthio group, etc.). Of these, the alkyl, alkoxy and aryloxy groups are preferred.

$R_7$, $R_8$, $R_9$ and $R_{10}$, which may be the same or different, each represents a hydrogen atom, an alkyl group having 1 to 25 carbon atoms (for example, a methyl group, an ethyl group, an isopropyl group, a n-butyl group, a tert-butyl group, a cyclohexyl group, a n-octyl group, a n-hexadecyl group, a benzyl group, a 2-ethylhexyl group, etc.) or an aryl group having 6 to 25 carbon atoms (for example, a phenyl group, a p-methoxyphenyl group, a p-hydroxyphenyl group, a 3,5-dichlorophenyl group, a m-methylphenyl group, a p-phenylphenyl group, a β-naphthyl group, etc.). Further, at least one of pairs of $R_7$ and $R_9$ and $R_{10}$ may be connected each other to form a 5-membered or 6-membered ring such as a benzene ring, a naphthalene ring, a cyclohexane ring, a cyclopentane ring, etc.

Of the compounds represented by the general formula (III) or (IV), those wherein $R_7$ and $R_8$ and $R_9$ and $R_{10}$ are connected to each other to form benzene rings, respectively are preferred from a viewpoint of the effect of the present invention.

Of the compounds for formulae (II), (III) and (IV), those represented by formula (II) are preferred.

Specific examples of the compounds represented by the general formula (II), (III) or (IV) which can be employed in the present invention are set forth below, but the present invention should not be construed as being limited thereto.

A-1

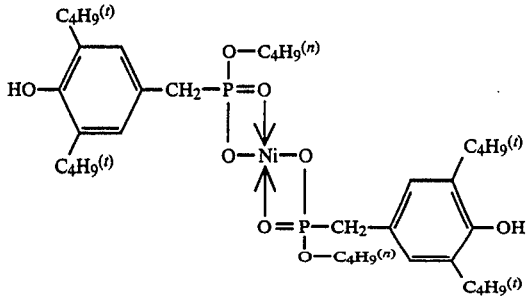

A-2

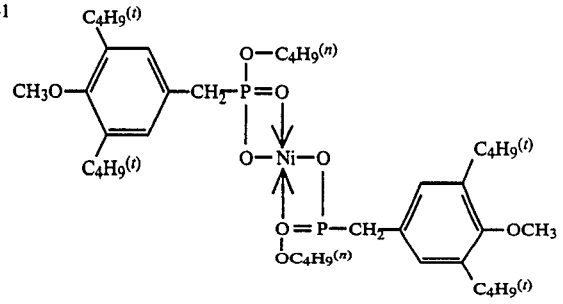

A-3

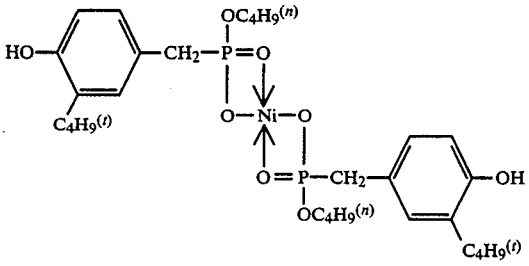

A-4

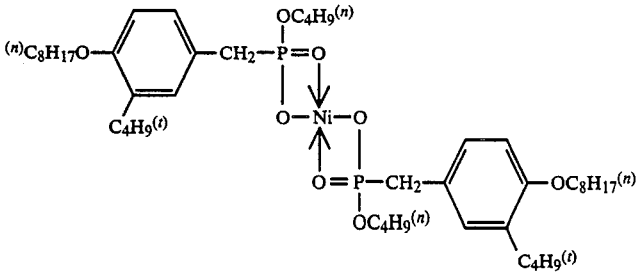

A-5

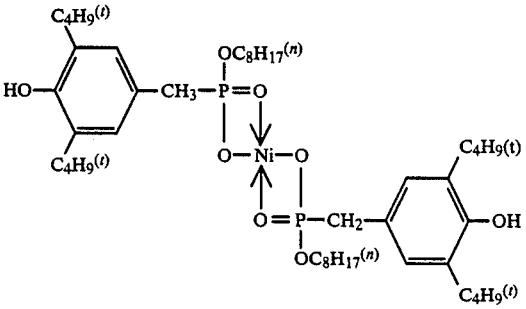

A-6

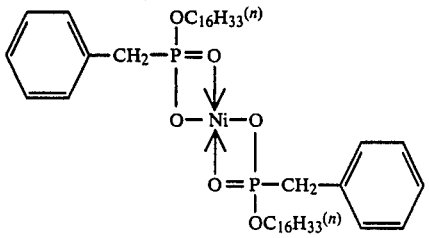

-continued
A-7
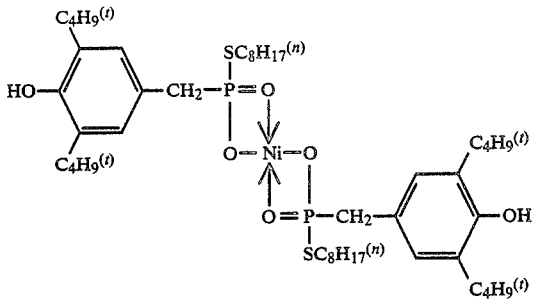
A-8
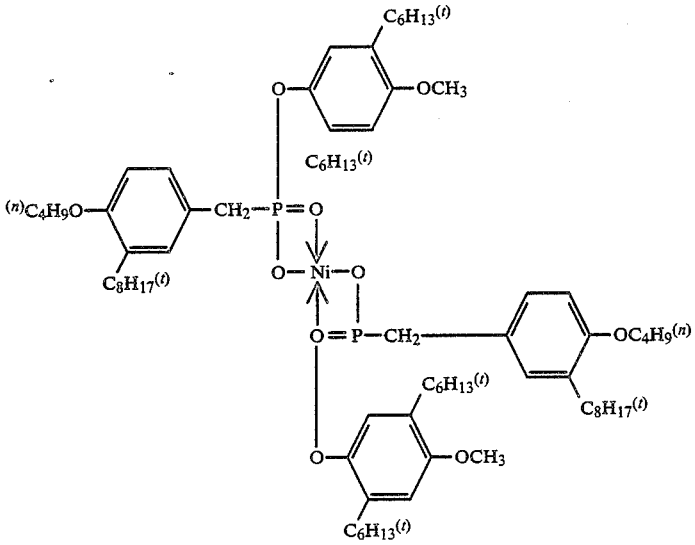
A-9
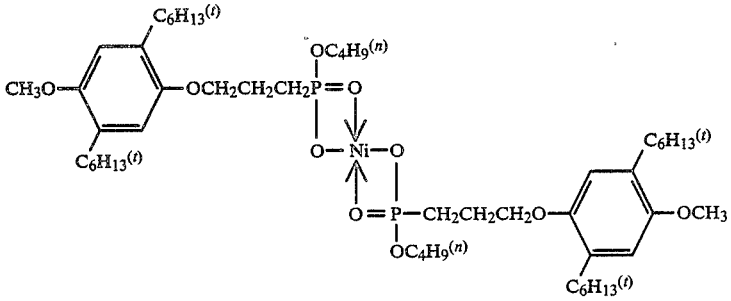
A-10
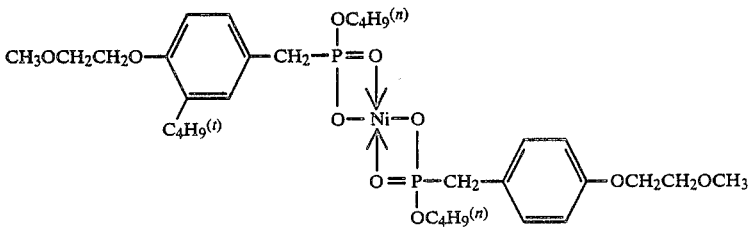

-continued
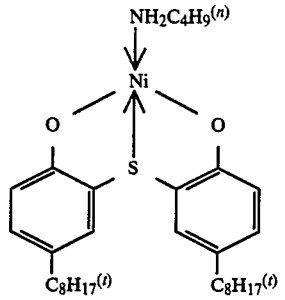
B-1
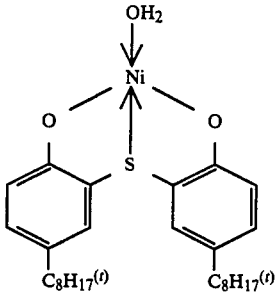
B-2
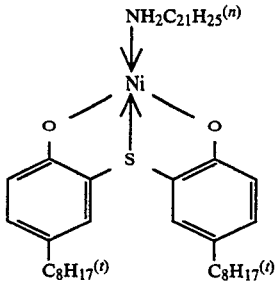
B-3
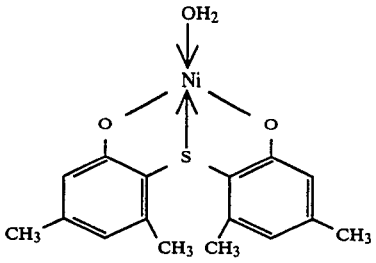
B-4
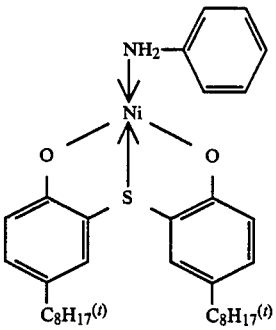
B-5
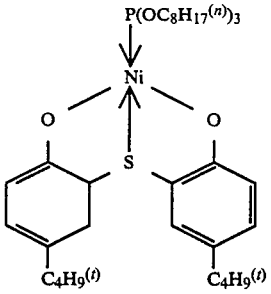
B-6
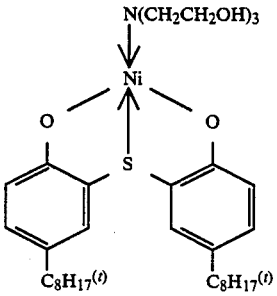
B-7
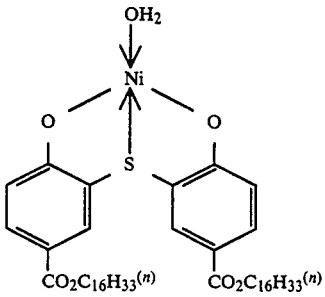
B-8

-continued

C-1

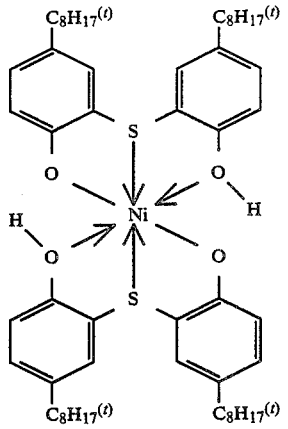

C-2

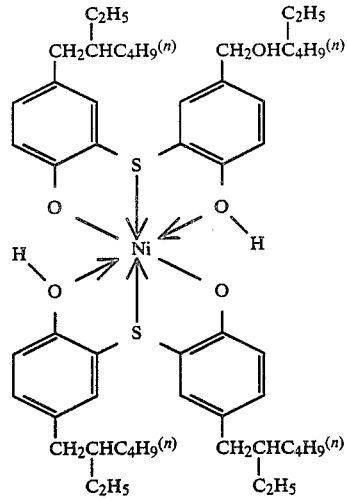

These compounds can be synthesized with reference to the methods as described in British Pat. Nos. 858,890 and 1,325,496, West German Pat. No. 2,042,652, etc.

The amount of the compound represented by the general formula (II), (III) or (IV) used in the present invention ranges from 1 to 100 mol%, and preferably from 5 to 50 mol%, based on the amount of coupler represented by the general formula (I).

Two or more kinds of the compounds represented by the general formulae (II), (III) and (IV) according to the present invention can be employed together, and the compounds may be employed together with other known color fading preventing agents.

Examples of known color fading preventing agents include hydroquinones, phenols, chromanols, coumarans, hindered amines, complexes, etc. Specific examples thereof are described, for example, in Japanese patent application (OPI) Nos. 83162/84, 24141/83 and 152225/77, U.S. Pat. Nos. 3,698,909 and 4,268,593, British Pat. Nos. 2,069,162 (A) and 2,027,731, etc.

Further, it is more preferred to employ the color image stabilizing compounds together with known dialkoxybenzene derivatives, for example, those as described in U.S. Pat. Nos. 4,360,589 and 4,273,864, Japanese patent application (OPI) Nos. 50244/80, 20327/78, 77526/78 and 10539/84, Japanese patent publication No. 37856/82, etc.

The pyrazoloazole type magenta coupler represented by the general formula (I) described above and the compound represented by the general formula (II), (III) or (IV) described above are preferably incorporated into the same silver halide emulsion layer. Generally, they are incorporated into a green-sensitive emulsion layer. It is more preferred that they are coemulsified.

In order to fulfill characteristics required for the light-sensitive material, two or more kinds of the couplers, etc. described above can be incorporated into the same layer, or the same compound may be incorporated into two or more layers.

In order to introduce the magenta couplers represented by the general formula (I) and the compounds represented by the general formula (II), (III) or (IV) according to the present invention into a silver halide emulsion layer, known methods, for example, the method as described in U.S. Pat. No. 2,322,027 can be utilized. For example, they can be dissolved into a solvent and then dispersed into a hy rophilic colloid. Examples of solvents usable for this method include organic solvents having a high boiling point, such as alkyl esters of phthalic acid (e.g., dibutyl phthalate, dioctyl phthalate, etc.), phosphonic acid esters (e.g., diphenyl phosphate, triphenyl phosphate, tricresyl phosphate, dioctyl butyl phosphate, etc.), citric acid esters (e.g., tributyl acetyl citrate, etc.), benzoic acid esters (e.g., octyl benzoate, etc.), alkylamides (e.g., diethyl laurylamides, etc.), fatty acid esters (e.g., dibutoxyethyl succinate, diethyl azelate, etc.) and trimesic acid esters (e.g., tributyl trimesate, etc.); and organic solvents having a boiling point of from about 30° to about 150° C., such as lower alkyl acetates (e.g., ethyl acetate, butyl acetate, etc.), ethyl propionate, secondary butyl alcohol, methyl isobutyl ketone, $\beta$-ethoxyethyl acetate, methyl cellosolve acetate, or the like. Mixtures of the organic solvents having a high boiling point described above and the organic solvents having a low boiling point described above can also be used.

The hydrophilic colloid layer of the photographic light-sensitive material of the present invention can contain ultraviolet ray absorbing agents. Useful ultraviolet ray absorbing agents include, for example, benzotriazole compounds substituted with an aryl groups (e.g., those described in U.S. Pat. No. 3,533,794), 4-thiazolidone compounds (e.g., those described in U.S. Pat. Nos. 3,314,794 and 3,352,681), benzophenone compounds (e.g., those described in Japanese patent application (OPI) No. 2784/71), cinnamic acid ester compounds (e.g., those described in U.S. Pat. Nos. 3,705,805 and 3,707,375), butadiene compounds (e.g., those described in U.S. Pat. No. 4,045,229) or benzoxazole compounds (e.g., those described in U.S. Pat. No. 3,700,455) can be employed. Furthermore, the compounds as described in U.S. Pat. No. 3,499,762, Japanese patent application (OPI) No. 48535/79 can also be used. Ultraviolet ray absorbing couplers (e.g., $\alpha$-naphthol type cyan dye forming couplers) and ultraviolet ray absorbing polymers can also be employed. These ultraviolet ray absorbing agents can also be mordanted in a specific layer(s), if desired.

The ultraviolet ray absorbing agents may be incorporated into any of the layers constituting the color photographic light-sensitive material of the present invention. It is preferred to incorporate them into a protective layer or an intermediate layer. When a protective layer is divided into two layers, the ultraviolet ray absorbing agent may be added to either layer. A suitable amount of the ultraviolet ray absorbing agent to be used ranges from $1\times10^{-4}$ mol to $2\times10^{-3}$ mol/m$^2$.

In the present invention, various color couplers can be employed and specific examples thereof are described in the patents cited in *Research Disclosure,* No. 17643, "VII-C" to "VII-G". As dye forming couplers, couplers capable of providing three primary colors (i.e., yellow, magenta and cyan) in the subtractive process upon color development are important. Specific examples of preferred diffusion-resistant, four-equivalent or two-equivalent couplers are described in the patents cited in *Research Disclosure,* No. 17643, "VII-C" and "VII-D" as mentioned above. In addition, couplers as described below are preferably employed in the present invention.

As typical yellow couplers used in the present invention, hydrophobic acylacetamide couplers having a ballast group are exemplified. Specific examples thereof are described in U.S. Pat. Nos. 2,407,210, 2,875,057 and 3,265,506, etc. In the present invention two-equivalent yellow couplers are preferably employed.

Typical examples of two-equivalent yellow couplers include yellow couplers containing a coupling-off group bonded to the coupling position through an oxygen atom as described in U.S. Pat. Nos. 3,408,194, 3,447,928, 3,933,501 and 4,022,620, etc. and yellow couplers containing a coupling-off group bonded to the coupling position through a nitrogen atom releasing type as described in Japanese Patent Publication No. 10739/83, U.S. Pat. Nos. 4,401,752 and 4,326,024, *Research Disclosure,* No. 18053 (April 1979), British Pat. No. 1,425,020, West German Patent Application (OLS) Nos. 2,219,917, 2,261,361, 2,329,587 and 2,433,812, etc. Hydrophobic α-pivaloylacetanilide couplers are characterized by fastness, particularly light fastness, of the dyes formed, and hydrophobic α-benzoylacetanilide couplers are characterized by their good color forming properties to provide a high color density.

As magenta couplers which can be used together with the pyrazoloazole magenta couplers in the present invention, hydrophobic indazolone couplers, cyanoacetyl type couplers, and preferably 5-pyrazolone couplers each having a ballast group are exemplified. Of the 5-pyrazolone couplers, those substituted with an arylamino group or an acylamino group at the 3-position thereof are preferred in view of hue of the dyes formed therefrom and color density. Typical examples thereof are described in U.S. Pat. Nos. 2,311,082, 2,343,703, 2,600,788, 2,908,573, 3,062,653, 3,152,896.and 3,936,015, etc. As releasing groups for two-equivalent 5-pyrazolone couplers, nitrogen atom releasing groups as described in U.S. Pat. No. 4,310,619 and arylthio groups as described in U.S. Pat. No. 4,351,897 are particularly preferred. Further, 5-pyrazolone couplers having the ballast group as described in European Pat. No. 73,636 are advantageous since they provide high color density.

As cyan couplers used in the present invention, hydrophobic and diffusion-resistant hydrophobic naphthol type and hydrophobic phenol couplers are exemplified. Typical examples thereof include hydrophobic naphthol couplers as described in U.S. Pat. No. 2,474,293 and preferably two-equivalent hydrophobic naphthol couplers containing a coupling-off group bonded to the coupling position through an oxygen atom as described in U.S. Pat. Nos. 4,052,212, 4,146,396, 4,228,233 and 4,296,200, etc. Specific examples of hydrophobic phenol couplers are described in U.S. Pat. Nos. 2,369,929, 2,801,171, 2,772,162 and 2,895,826, etc.

Cyan couplers fast to humidity and temperature are preferably used in the present invention. Typical examples thereof include hydrophobic phenol cyan couplers having an alkyl group more than a methyl group at the meta-position of the phenol nucleus as described in U.S. Pat. No. 3,772,002, 2,5-diacylamino-substituted hydrophobic phenol couplers as described in U.S. Pat. Nos. 2,772,162, 3,758,308, 4,126,396, 4,334,011 and 4,327,173, West German Patent Application (OLS) No. 3,329,729, and European Pat. No. 121,365, etc., hydrophobic phenol couplers having a phenylureido group at the 2-position thereof and an acylamino group at the 5-position thereof as described in U.S. Pat. Nos. 3,446,622, 4,333,999, 4,451,559 and 4,427,767, etc. Further, cyan couplers of the hydrophobic naphthol having a sulfonamido group or an amido group, etc. at the 5-position thereof as described in Japanese patent application Nos. 93605/84, 264277/84 and 268135/84 are also preferably employed in the present invention because of excellent fastness of color images formed therefrom.

It is preferred to use colored couplers for masking in color photographic light-sensitive materials for photographing in order to correct undesirable absorptions of dyes formed. Typical examples of colored couplers include yellow-colored magenta couplers as described in U.S. Pat. No. 4,163,670 and Japanese patent publication No. 39413/82, etc., and magenta-colored cyan couplers as described in U.S. Pat. Nos. 4,004,929 and 4,138,258 and British Pat. No. 1,146,368, etc. Other examples of useful colored couplers are described in *Research Disclosure,* No. 17643, "VII-G" (mentioned above).

Further, couplers capable of forming appropriately diffusible dyes can be used together in order to improve graniness. Specific examples of such types of magenta couplers are described in U.S. Pat. No. 4,366,237 and British Pat. No. 2,125,570, etc. and those of yellow, magenta and cyan couplers are described in European Pat. No. 96,570 and West German Patent Application (OLS) No. 3,234,533, etc.

The above described couplers may form polymers including dimers or more. Typical examples of polymerized dye forming couplers are described in U.S. Pat. Nos. 3,451,820 and 4,080,211, etc. Specific examples of polymerized magenta couplers are described in British Pat. No. 2,102,173 and U.S. Pat. No. 4,367,282, etc.

Couplers capable of releasing a photographically useful residue during the course of coupling can be also employed preferably. Specific examples of useful DIR couplers capable of releasing a development inhibitor are described in the patents cited in *Research Disclosure,* No. 17643, "VII-F" described above.

Of the DIR couplers, those which deactivate in a developing solution as Japanese patent application (OPI) No. 151944/82, those with timing groups as shown in U.S. Pat. No. 4,248,962 and Japanese patent application (OPI) No. 154234/82 and those of which are reactive as shown in Japanese patent application No. 39653/84, etc., are preferably employed in the present invention. Further, DIR couplers which deactivate in a developing solution in Japanese patent application (OPI) Nos. 151944/82, 217932/83, 218644/85, 225156/85, and 233650/85, etc. and DIR couplers which are reactive as described in Japanese patent application No. 184248/85, etc. are particularly preferred.

In the photographic light-sensitive material of the present invention, couplers which release imagewise a nucleating agent, a development accelerator or a precursor thereof at the time of development can be employed. Specific examples of such compounds are described in British Pat. Nos. 2,097,140 and 2,131,188, etc. Couplers which release a nucleating agent having an adsorption function to silver halide are particularly preferred and specific examples thereof are described in Japanese patent application (OPI) Nos. 157638/84 and 170840/84, etc.

In the photographic emulsion layers of the photographic light-sensitive material of the present invention, any of silver bromide, silver iodobromide, silver iodochlorobromide, silver chlorobromide and silver chloride may be used as the silver halide. A preferred silver halide is silver iodobromide or silver iodochlorobromide each containing about 30 mol% or less of silver iodide. Silver iodobromide containing from about 2 mol% to about 25 mol% of silver iodide is particularly preferred.

The silver halide grain may have a regular crystal structure, for example, a cubic, octahedral or tetradecahedral structure, etc., an irregular crystal structure, for example, a spherical structure, etc., a crystal defect, for example, a twin plane, etc., or a composite structure thereof.

The grain size of the silver halide may be varied and include from fine grains having about 0.1 micron or less to large size grains having about 10 microns of a diameter of projected area. Further, a monodispersed emulsion having a narrow grain size distribution and a polydispersed emulsion having a broad grain size distribution may be used.

The silver halide photographic emulsion used in the present invention can be prepared using known methods, for example, those as described in *Research Disclosure,* Vol. 176, No. 17643 (December 1978), pages 22 to 23, "I. Emulsion Preparation and Types" and ibid., Vol. 187, No. 18716 (November 1979), page 648, etc.

The photographic emulsion as used in the present invention can be prepared in any suitable manner, e.g., by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, any of an acid process, a neutral process, an ammonia process, etc., can be employed.

Soluble silver salts and soluble halogen salts can be reacted by techniques such as a single jet process, a double jet process, and a combination thereof. In addition, there can be employed a method (so-called reversal mixing process) in which silver halide particles are formed in the presence of an excess of silver ions.

As one system of the double jet process, a so-called controlled double jet process in which the pAg in a liquid phase where silver halide is formed is maintained at a predetermined level can be employed. This process can produce a silver halide emulsion in which the crystal form is regular and the grain size is nearly uniform.

Two or more kinds of silver halide emulsions which are prepared separately may be used as a mixture.

Silver halide emulsions composed of regular grains as described above can be obtained by controlling pAg and pH during the step of formation of silver halide grains. The details thereof are described, for example, in *Photographic Science and Engineering,* Vol. 6, pages 159 to 165 (1962), *Journal of Photographic Science,* Vol. 12, pages 242 to 251 (1964), U.S. Pat. No. 3,655,394, and British Pat. No. 1,413,748, etc.

Representative monodispersed emulsions are those comprising silver halide grains having an average grain size of about 0.1 micron or more and at least about 95% by weight of the total silver halide grains having a size within the range of ±40% of the average grain size. In the present invention, it is preferred to employ a monodispersed emulsion comprising silver halide grains having an average grain size of from 0.25 microns to 2 microns and at least 95% by weight or by number of particles of the total silver halide grains having a size within the range of ±20% of the average grain size. Methods for preparation of such monodispersed emulsions are described in U.S. Pat. Nos. 3,574,628 and 3,655,394, British Pat. No. 1,413,748, etc. Further, monodispersed emulsions as described in Japanese patent application (OPI) Nos. 8600/73, 39027/76, 83097/76, 137133/78, 48521/79, 99419/79, 37635/83 and 49938/83, etc. can be preferably employed in the present invention.

Further, tabular silver halide grains having an aspect ratio of about 5 or more can be employed in the present invention. The tabular grains may be easily prepared by the method as described in Gutoff, *Photographic Science and Engineering,* Vol. 14, pages 248 to 257 (1970), U.S. Pat. Nos. 4,434,226, 4,414,310, 4,433,048 and 4,439,520, British Pat. No. 2,112,157, etc. In the case of employing the tabular silver halide grains, it is described in detail that many advantage, for example, increase in spectral sensitizing efficiency with a sensitizing dye, improvement in graininess and improvement in sharpness, etc., are obtained in U.S. Pat. No. 4,434,226, etc., mentioned above.

The Crystal structure of silver halide grains may be uniform, composed of different halide compositions between the inner portion and the outer portion, or may have a layer structure. Examples of such emulsion grains are described in British Pat. No. 1,027,146, U.S. Pat. Nos. 3,505,068 and 4,444,877, and Japanese patent application No. 248469/83, etc.

Further, silver halide emulsions in which silver halide grains having different compositions are connected upon epitaxial junctions or silver halide emulsions in which silver halide grains are connected with compounds other than silver halide such as silver thiocyanate, lead oxide, etc. may also be employed. Examples of these emulsion grains are described in U.S. Pat. Nos. 4,094,684, 4,142,900 and 4,459,353, British Pat. No. 2,038,792, U.S. Pat. Nos. 4,349,622, 4,395,478, 4,433,501, 4,463,087, 3,656,962 and 3,852,067, Japanese Patent Application (OPI) No. 162540/84, etc.

Moreover, a mixture of grains having a different crystal structure may be used.

The photographic emulsions used in the present invention are usually conducted with physical ripening, chemical ripening and spectral sensitization. Various kinds of additives which can be employed in these steps are described in *Research Disclosure,* No. 17643 (December 1978) and ibid., No. 18716 (November 1979) as mentioned above and some of them are summarized in the table shown below.

Futher, other known photographic additives which can be used in the present invention are also described in the above mentioned documents and some of them are summarized in the table below.

| Kind of Additives | RD 17643 | RD 18716 |
|---|---|---|
| 1. Chemical Sensitizers | Page 23 | Page 648, right column |
| 2. Sensitivity Increasing Agents | — | Page 648, right column |
| 3. Spectral Sensitizers and Super Sensitizers | Pages 23 to 24 | Page 648, right column to Page 649, right column |
| 4. Whitening Agents | Page 24 | — |
| 5. Antifoggants and Stabilizers | Pages 24 to 25 | Page 649, right column |
| 6. Light-Absorbers, Filter Dyes and Ultraviolet Ray Absorbers | Pages 25 to 26 | Page 649, right column to Page 650, left column |
| 7. Antistaining Agents | Page 25, right column | Page 650, left column to right column |
| 8. Dye Image Stabilizers | Page 25 | — |
| 9. Hardeners | Page 26 | Page 651, left column |
| 10. Binders | Page 26 | Page 651, left column |
| 11. Plasticizers and Lubricants | Page 27 | Page 650, right column |
| 12. Coating Aids and Surfactants | Pages 26 to 27 | Page 650, right column |
| 13. Antistatic Agents | Page 27 | Page 650, right column |

Suitable supports which can be used in the present invention are described, for example, in *Research Disclosure,* No. 17643, page 28 and ibid., No. 18716, page 647, right column to page 648, left column, as described above.

The color photographic light-sensitive material according to the present invention can be subjected to development processing in a conventional manner as described in *Research Disclosure,* No. 17643, pages 28 to 29 and ibid., No. 18716, page 651, left column to right column.

After development, bleach-fixing or bleaching and fixing, the color photographic material according to the present invention is usually subjected to a water washing process or a stabilizing process.

The water washing step is generally conducted by a countercurrent water washing step using two or more tanks in order to reduce am amount of water used. As a stabilizing processing, a representative example of which is a multistage countercurrent stabilizing process as described in Japanese Patent Application (OPI) No. 8543/82, is used in place of the water washing step. In this step two to nine tanks of countercurrent baths are necessary. To the stabilizing bath various kinds of compounds are added for the purpose of stabilizing images formed. Representative examples of the additives include various buffers (for example, borates, methaborates, borax, phosphates, carbonates, potassium hydroxide, sodium hydroxide, aqueous ammonia, monocarboxylic acids, dicarboxylic acids, polycarboxylic acids, etc. being used alone or in combination) for the purpose of adjusting pH of layers (for example, pH of 3 to 8), and a formalin, etc. In addition, various additives, for example, water softeners (for example, inorganic phosphoric acids, aminopolycarboxylic acids, organic phosphoric acids, aminopolyphosphonic acids, phosphonocarboxylic acids, etc.), sterilizers (for example, benzoisothiazololinones, isothiazolones, 4-thiazolinebenzimidazoles, halogenated phenols, etc.), surface active agents, fluorescent whitening agents, hardeners, etc. may be employed, if desired. Two or more compounds for the same or different purposes may be employed together.

Further, it is preferred to add various ammonium salts such as ammonium chloride, ammonium nitrate, ammonium sulfate, ammonium phosphate, ammonium sulfite, ammonium thiosulfate, etc., as pH adjusting agents for layers after development processing.

The present invention can be applied to various color photographic light-sensitive materials. Representative examples include color negative films for general use or movies, color reversal films for slides or television, color paper, color positive films and color reversal paper, etc. The present invention is also applied to black and white photographic light-sensitive materials utilizing a mixture of three color couplers as described in *Research Disclosure,* No. 17123 (July 1978), etc. These color photographic materials may be those in which one or more light-sensitive layers each comprise one or more unit layers having the same color sensitivity.

The present invention will now be illustrated in greater detail with references to the following examples, but these examples should not be construed as limiting the present invention.

EXAMPLE 1

In a mixture of 20 ml of tricresyl phosphate and 20 ml of ethyl acetate was dissolved 10 g of Magenta Coupler (a), i.e., 1-(2,4,6-trichlorophenyl)-3-[(2-chloro-5-tetradecanamido)anilino]-2-pyrazolin-5-one. The solution was dispersed in 80 g of a gelatin solution containing 8 ml of a 1% aqueous soluton of sodium dodecylbenzenesulfonate.

The resulting dispersion was mixed with 145 g of a green-sensitive silver chlorobromide emulsion (bromide content: 50 mol%; Ag content: 7 g), and sodium dodecylbenzenesulfonate was added thereto as a coating aid. The resulting mixture was coated on a paper support laminated on both sides thereof with polyethylene to a coupler coverage of 400 mg/m$^2$. Onto the emulsion layer was coated a gelatin protective layer to a gelatin coverage of 1 g/m$^2$. The resulting sample was designated Sample A.

The same procedure as described above was repeated except that the coupler dispersion was prepared by using a combination of the coupler of the general formula (I) according to the present invention and the compound of the general formula (II), (III) or (IV) according to the present invention or a comparative compound as shown in Table 1 below. The compound of the general formula (II), (III) or (IV) or the comparative compound was added in an amount of 20 mol% based on the coupler. The resulting samples were designated Samples B to K.

Each of the samples was exposed to light of 1,000 lux for 1 second and subjected to the following processing.

| Processing Step | Temperature (°C.) | Time |
|---|---|---|
| Development | 33 | 3 min 30 sec |
| Bleach-Fixing | 33 | 1 min 30 sec |
| Washing with water | 28–35 | 3 min |

Processing solutions used in each step had the following compositions:

| Developing Solution: | |
|---|---|
| Benzyl alcohol | 15 ml |
| Diethylenetriaminepentaacetic acid | 5 g |
| KBr | 0.4 g |
| $Na_2SO_3$ | 5 g |

-continued

| | |
|---|---|
| $Na_2CO_3$ | 30 g |
| Hydroxylamine sulfate | 2 g |
| 4-Amino-3-methyl-N—ethyl-N—β-(methanesulfonamido)ethylaniline.3/2$H_2SO_4$.$H_2O$ | 4.5 g |
| Water to make | 1,000 ml (pH = 10.1) |
| Bleach-Fixing Solution: | |
| Ammonium thiosulfate (70 wt %) | 150 ml |
| $Na_2SO_3$ | 5 g |
| Na[Fe(EDTA)] | 49 g |
| EDTA | 4 g |
| Water to make | 1,000 ml (pH = 6.8) |

The sample having a dye image formed thereon was subjected to a fading test for 6 days through an ultraviolet ray absorbing filter made by Fuji Photo Film Co., Ltd., which cut light of 400 nm or less using a xenon tester (illuminance: 200,000 lux). A change in density at the area having an initial density of 2.0 was determined using a Macbeth densitometer, RD-514 model (Status AA filter). The results thus obtained are shown in Table 1.

TABLE 1

| Sample No. | Magenta Coupler | Color Image Stabilizer | Magenta Density change (initial density 2.0) | Remark |
|---|---|---|---|---|
| A | Magenta Coupler (a) | — | −1.68 | Comparison |
| B | Magenta Coupler (a) | A-1 | −1.12 | Comparison |
| C | Magenta Coupler (a) | B-3 | −0.74 | Comparison |
| D | M-5 | — | −1.82 | Comparison |
| E | " | A-1 | −0.36 | Present Invention |
| F | " | B-3 | −0.31 | Present Invention |
| G | M-31 | — | −1.85 | Comparison |
| H | " | B-7 | −0.34 | Present Invention |
| I | " | C-1 | −0.39 | Present Invention |
| J | " | Compound (A) | −1.37 | Comparison |
| K | " | Compound (B) | −1.62 | Comparison |

Compound (A):

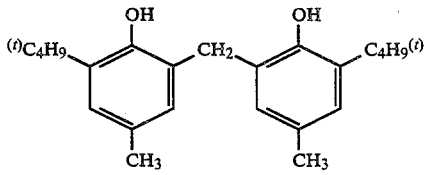

(disclosed in GB-1529908B).

Compound (B):

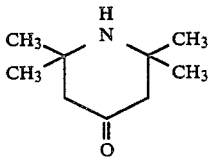

(disclosed in British Pat. No. 1,326,899).

From the results shown in Table 1 it can be seen that the compounds according to the present invention exhibit particularly excellent light fastness improving effect as compared to known color fading preventing agents and that the light fastness improviding effect of the compounds according to the present invention on the couplers according to the present invention is remarkably larger than on the 5-pyrazolone type magenta couplers.

EXAMPLE 2

A coating composition was prepared in the same manner as for Sample A in Example 1 except for using M-31 as a magenta coupler, and a multilayer sample having a layer structure as shown in Table 3 below was prepared using the resulting coating composition as a third layer. The resulting sample was designated Sample L. Samples M, N and O were prepared in the same manner as described above except that the coating composition for the third layer further containing the color image stabilizer as shown in Table 2 below.

Each of the resulting samples was subjected to light exposure and development processing in the same manner as described in Example 1. The sample having formed thereon a dye image was subjected to fading test using a fluorescent lamp fade tester (15,000 lux) for 4 weeks. The change in density at the area having an initial density of 1.0 was measured, and the results thus obtained are shown in Table 2.

TABLE 2

| Sample No. | Color Image Stabilizer | Amount Added (mol %/ Coupler) | Magenta Density change (initial density 2.0) | Remark |
|---|---|---|---|---|
| L | — | — | −0.51 | Comparison |
| M | B-7 | 20 | −0.17 | Present Invention |
| N | C-1 | 20 | −0.19 | Present Invention |
| O | B-7/Compound (C) | 20/50 | −0.08 | Present Invention |

Compound (C):

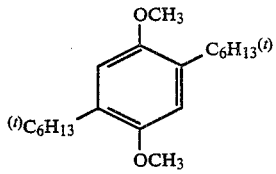

TABLE 3

| Layer | Component | Coverage ($mg/m^2$) |
|---|---|---|
| 7th | Gelatin | 1,600 |
| 6th | Gelatin | 1,000 |
| | Ultraviolet ray absorbing agent(1) | 360 |
| | Solvent for ultraviolet ray absorbing agent(2) | |
| 5th | Silver chlorobromide emulsion Br: 50 mol %) | 250 (as Ag) |
| | Cyan coupler(3) | 500 |
| | Solvent for coupler(2) | 250 |
| | Gelatin | 1,200 |
| 4th | Gelatin | 1,600 |
| | Ultraviolet ray absorbing agent(1) | 700 |
| | Color mixing preventing agent(4) | 200 |
| | Solvent(2) | 300 |
| 3rd | Silver chlorobromide emulsion Br: 50 mol %) | 180* (as Ag) |

TABLE 3-continued

| Layer | Component | Coverage (mg/m²) |
|---|---|---|
| | Magenta coupler(5) (6) | 320** |
| | Solvent for coupler(7) | 320*** |
| 2nd | Gelatin | 1,100 |
| | Color mixing preventing agent(4) | 200 |
| | Solvent(2) | 100 |
| 1st | Silver chlorobromide emulsion | 350 |
| | (Br: 80 mol %) | (as Ag) |
| | Yellow coupler(8) | 500 |
| | Solvent for coupler(9) | 400 |
| | Gelatin | 1,500 |
| Support | Paper support laminated with polyethylene on both sides thereof | |

Note:
Ultraviolet ray absorbing agent(1): 2-(2-Hydroxy-3-sec-butyl-5-t-butylphenyl)-benzotriazole
Solvent(2): Dibutyl phthalate
Cyan coupler(3): 2-[α-(2,4-Di-tert-pentylphenoxy)-butanamido] -4,6-dichloro-5-methylphenol
Color mixing preventing agent(4): 2,5-Dioctylhydroquinone
Magenta coupler(5): M-5
Comparative magenta coupler(6): Comparative Magenta Coupler (a)
Solvent for coupler(7): Tricresyl phosphate
Yellow coupler(8): α-Pivaloyl-α-(2,4-dioxo-5,5'-dimethyl-oxazolidin-3-yl)-2-chloro-5-[α-(2,4-di-tert-pentylphenoxy)butanamido]-acetanilide
Solvent coupler(9): Dioctylbutyl phosphate
*360 mg/m² for comparative samples
**280 mg/m² for the comparative magenta coupler
***280 mg/m² for comparative samples From the results shown in Table 2, it can be understood that the color image stabilizers according to the present invention exhibit a significant effect of color image stabilization in the multilayer photographic materials. It ia also noted that the effect of the present invention is increased by the use of the color image stabilizer according to the present invention together with another color image stabilizer.

As described hereinbefore, the color photographic light-sensitive material according to the present invention in which a combination of the pyrazoloazole type magenta coupler represented by the general formula (I) and the color image stabilizer represented by the general formula (II), (III) or (IV) is employed can provide color images remarkably improved in light fastness.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide emulsion layer, the silver halide color photographic material containing at least one pyrazoloazole type coupler represented by the general formula (I) described below and at least one compound represented by the general formula (II) described below

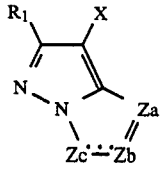

(I)

wherein $R_1$ represents a hydrogen atom or a substituent; X represents a hydrogen atom or a group capable of being released upon a coupling reaction with an oxidation product of an aromatic primary amine developing agent; Za, Zb and Zc each represents a methine group, a substituted methine group, =N— or —NH—, one of the Za—Zb bond and the Zb—Zc bond being a double bond and the other being a single bond; when the Zb—Zc bond is a carbon-carbon double bond, the Zb—Zc bond may be a part of a condensed aromatic ring; $R_1$ or X may also form a polymer including a dimer or more; and when Za, Zb or Zc is a substituted methine group, the substituted methine group may form a polymer including a dimer or more, with the proviso that when Za and Zb are nitrogen atoms and Zc is a methine group or a substituted methine group, X is not a hydrogen atom,

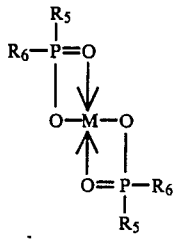

(II)

wherein M represents a nickel atom, a cobalt atom, a manganese atom, a copper atom, a iron atom a zinc atom, a palladium or a platinum atom; $R_5$ and $R_6$, which may be the same or different, each represents an alkyl group, an aryl group, an alkoxy group, an alkylthio group, an aryloxy group or an arylthio group.

2. A silver halide color photographic material as claimed in claim 1, wherein the pyrazoloazole type coupler is a bis coupler or a polymer coupler containing a coupler moiety represented by the general formula (I).

3. A silver halide color photographic material as claimed in claim 2, wherein the polymer coupler is a homopolymer composed of a monomer having a coupler moiety represented by the general formula (I) or a copolymer composed of a monomer having a coupler moiety represented by the general formula (I) and a non-color forming ethylenic monomer which does not undergo coupling with the oxidation product of an aromatic primary amine developing agent.

4. A silver halide color photographic material as claimed in claim 1, wherein the pyrazoloazole type coupler is represented by the following general formula (I-1), (I-2), (I-3), (I-4), (I-5) or (I-6):

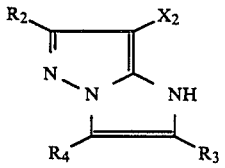

(I-1)

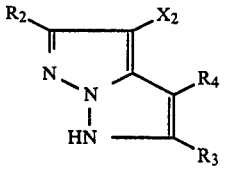

(I-2)

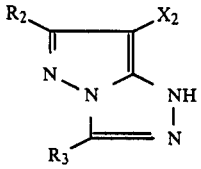

(I-3)

-continued (I-4)

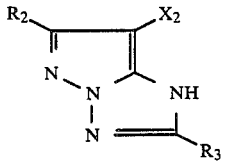

(I-5)

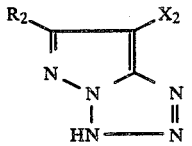

(I-6)

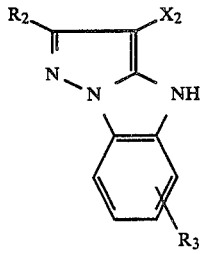

wherein $R_2$, $R_3$ and $R_4$, which may be the same or different, each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and $X_2$ represents a hydrogen atom, a halogen atom, a carboxy group or a group capable of being released upon coupling which is bonded to the carbon atom at the coupling position through an oxygen atom, a nitrogen atom or a sulfur atom; or $R_2$, $R_3$, $R_4$ or $X_2$ is a divalent group to form a bis coupler.

5. A silver halide color photographic material as claimed in claim 4, wherein $X_2$ is other than the hydrogen atom.

6. A silver halide color photographic material as claimed in claim 4, wherein the pyrazoloazole type coupler is a polymer coupler in which the coupler moiety derived from the coupler represented by the general formula (I-1), (I-2), (I-3), (I-4), (I-5) or (I-6) is present in a vinyl monomer, and $R_2$, $R_3$ or $R_4$ represents a chemical bond or a linking group, through which the coupler moiety is connected to the vinyl group in the vinyl monomer.

7. A silver halide color photographic material as claimed in claim 4, wherein the divalent group to form a bis coupler represented by $R_2$, $R_3$, $R_4$ or $X_2$ is a substituted or unsubstituted alkylene group, a substituted or unsubstituted phenylene group or a group of the formula —NHCO—R—CONH—, wherein R represents a substituted or unsubstituted alkylene group or a substituted or unsubstituted phenylene group.

8. A silver halide color photographic material as claimed in claim 6, wherein the linking group represented by $R_2$, $R_3$ or $R_4$ is a substituted or unsubstituted alkylene group, a substituted or unsubstituted phenylene group, —NHCO—, —CONH—, —O—, —OCO—, an aralkylene group or a combination thereof.

9. A silver halide color photographic material as claimed in claim 6, wherein the vinyl group may further have a substituent selected from a chlorine atom and a lower alkyl group having from 1 to 4 carbon atoms in addition to the coupler moiety.

10. A silver halide color photographic material as claimed in claim 6, wherein the polymer coupler is a homopolymer.

11. A silver halide color photographic material as claimed in claim 6, wherein the polymer coupler is a copolymer.

12. A silver halide color photographic material as claimed in claim 6, wherein the polymer coupler is a copolymer containing a repeating unit derived from a non-color forming ethylenic monomer which does not couple with the oxidation product of an aromatic primary amine developing agent.

13. A silver halide color photographic material as claimed in claim 12, wherein the non-color forming ethylenic monomer is an acrylic acid, an ester of acrylic acid, an amide of acrylic acid, a vinyl ester, an acrylonitrile, an aromatic vinyl compound, itaconic acid, citraconic acid, crotonic acid, vinylidene chloride, a vinyl alkyl ether, maleic acid, maleic anhydride, an ester of maleic acid, N-vinyl-2-pyrrolidone, N-vinyl pyridine or 2- or 4-vinyl pyridine.

14. A silver halide color photographic material as claimed in claim 4, wherein the pyrazoloazole type coupler is represented by the general formula (I-1) or (I-4).

15. A silver halide color photographic material as claimed in claim 6, wherein the coupler moiety for the polymer coupler is derived from the coupler represented by the general formula (I-1) or (I-4).

16. A silver halide color photographic material as claimed in claim 1, wherein M represents a nickel atom.

17. A silver halide color photographic material as claimed in claim 1, wherein an amount of the compound represented by the general formula (II) is from 1 mol% to 100 mol% based on the coupler represented by the general formula (I).

18. A silver halide color photographic material as claimed in claim 1, wherein the silver halide color photographic material further contains a dialkoxybenzene color fading preventing agent.

19. A silver halide color photographic material as claimed in claim 1, wherein the silver halide color photographic material further contains an ultraviolet ray absorbing agent.

20. A silver halide color photographic material as claimed in claim 1, wherein the pyrazoloazole type coupler represented by the general formula (I) and the compound represented by the general formula (II) is present in the same silver halide emulsion layer.

21. A silver halide color photographic material as claimed in claim 20, wherein the silver halide emulsion layer is a green-sensitive silver halide emulsion layer.

* * * * *